US005517918A

United States Patent [19]

Van Denend

[11] Patent Number: 5,517,918

[45] Date of Patent: May 21, 1996

[54] DOCTOR BLADE CLAMPING ASSEMBLY FOR A PRINTING PRESS

[75] Inventor: Mark E. Van Denend, Paterson, N.J.

[73] Assignee: Fischer & Krecke GmbH & Co., Bielefeld, Germany

[21] Appl. No.: 282,261

[22] Filed: Jul. 29, 1994

[51] Int. Cl.[6] ..... B41F 31/05

[52] U.S. Cl. ..... 101/363; 101/366

[58] Field of Search ..... 101/157, 169, 101/154, 365, 363, 366, 350, 120, 148; 118/261; 15/256.51

[56] References Cited

U.S. PATENT DOCUMENTS

| | | | |
|---|---|---|---|
| 3,116,688 | 1/1964 | Ward, Jr. et al. . | |
| 3,120,802 | 2/1964 | Smejda . | |
| 3,399,420 | 9/1968 | Crist . | |
| 3,986,453 | 10/1976 | Boose . | |
| 4,241,691 | 12/1980 | Hopfe et al. . | |
| 4,315,425 | 2/1982 | Zbornik et al. | 72/481 |
| 4,665,859 | 5/1987 | Dunlap et al. . | |
| 4,938,131 | 7/1990 | Maggi . | |
| 4,940,354 | 7/1990 | Holderegger et al. . | |
| 5,101,725 | 4/1992 | Kobler et al. . | |

*Primary Examiner*—J. Reed Fisher
*Attorney, Agent, or Firm*—Richard M. Goldberg

[57] ABSTRACT

In a printing press having a chamber body, a doctor blade clamping assembly includes a leaf spring having a plurality of leaves assembled together in overlying relation to each other, the leaves being of different lengths; bolts extending through the leaf spring and secured to the chamber body, the bolts engaging the leaf spring to secure the leaf spring to the chamber body in at least partial overlying relation to a doctor blade such that the leaf spring applies a biasing force to the doctor blade to clamp the doctor blade to the chamber body; an inflatable bladder positioned in a recessed area in the chamber body and at least indirectly engaging the leaf spring when the bladder is inflated so as to bias the leaf spring in a direction away from the doctor blade to release the doctor blade from the biasing force of the leaf spring; a conduit connected with the bladder; a spacer positioned in the recessed area between the bladder and the leaf spring; a bladder control connected with the conduit, the bladder control supplying a pressurized gas through the conduit to the bladder to inflate the bladder and removing the pressurized gas from the bladder through the conduit to deflate the bladder; and a stop engaged with the chamber body and the leaf spring for limiting movement of the leaf spring in a direction away from the doctor blade.

21 Claims, 3 Drawing Sheets

DOCTOR BLADE CLAMPING ASSEMBLY FOR A PRINTING PRESS

BACKGROUND OF THE INVENTION

The present invention relates generally to printing machines, and more particularly, is directed to the clamping of a doctor blade relative to an anilox roll.

Conventionally, in printing machines, such as flexographic printing machines, an ink transfer or anilox roll transfers ink to an adjacent plate roll for printing. Ink is supplied to the anilox roll from an ink chamber defined by a chamber body which partially surrounds the anilox roll. Specifically, ink is supplied through an ink supply tube and then through an ink supply line in the chamber body, into the ink chamber. In like manner, ink is removed from the ink chamber through an ink return line in the chamber body and then through an ink return tube.

In order to prevent the escape of ink from the chamber, while ensuring that the ink enters the cells in the anilox roll and has a predetermined thickness on the anilox roll, doctor blades are provided at the entry and exit positions of the anilox roll relative to the ink chamber. The doctor blades are fixed to the chamber body by bolts so that the doctor blades overhang the chamber body and contact the anilox roll.

However, over time, the doctor blades become caked with ink and/or wear out. As a result, the doctor blades become ineffective for the above purposes, and must be changed. This, however, becomes time consuming and burdensome. Specifically, the bolts holding the doctor blades must be removed, whereupon the doctor blades are changed, and the bolts are retightened.

OBJECTS AND SUMMARY OF THE INVENTION

Accordingly, it is an object of the present invention to provide a doctor blade clamping assembly that overcomes the aforementioned problems.

It is another object of the present invention to provide a doctor blade clamping assembly in which the doctor blades are easily removable for changing the same.

It is still another object of the present invention to provide a doctor blade clamping assembly in which the doctor blades are held down by spring pressure which can be released by an inflatable bladder.

In accordance with an aspect of the present invention, in a printing press having a chamber body, a doctor blade clamping assembly includes a spring; a securing assembly secured to the chamber body and engaging the spring to secure the spring to the chamber body in at least partial overlying relation to a doctor blade such that the spring applies a biasing force to the doctor blade to clamp the doctor blade to the chamber body; and a biasing assembly positioned in a recessed area in the chamber body and which biases the spring in a direction away from the doctor blade to release the doctor blade from the biasing force.

Preferably, the spring includes a leaf spring having a plurality of leaves assembled together in overlying relation to each other, the leaves being of different lengths.

The securing assembly includes at least one bolt extending through the leaf spring and secured to the chamber body.

The biasing assembly includes an inflatable bladder positioned in the recessed area, the inflatable bladder at least indirectly engaging the spring when the bladder is inflated so as to bias the spring in a direction away from the doctor blade to release the doctor blade from the biasing force of the spring. In this regard, a conduit is connected with the bladder, and a bladder control is connected with the conduit, the bladder control supplying a pressurized gas through the conduit to the bladder to inflate the bladder and removing the pressurized gas from the bladder through the conduit to deflate the bladder.

In one embodiment, a spacer is positioned in the recessed area between the bladder and the spring.

In addition, a stop is engaged with the chamber body and the spring for limiting movement of the spring in a direction away from the doctor blade. In one embodiment, the stop includes a bolt extending partially through the spring and secured to the chamber body.

The above and other objects, features and advantages of the invention will become readily apparent from the following detailed description thereof which is to be read in connection with the accompanying drawings.

DETAILED DESCRIPTION OF THE PREFERRED EMBODIMENTS

Figure 1:
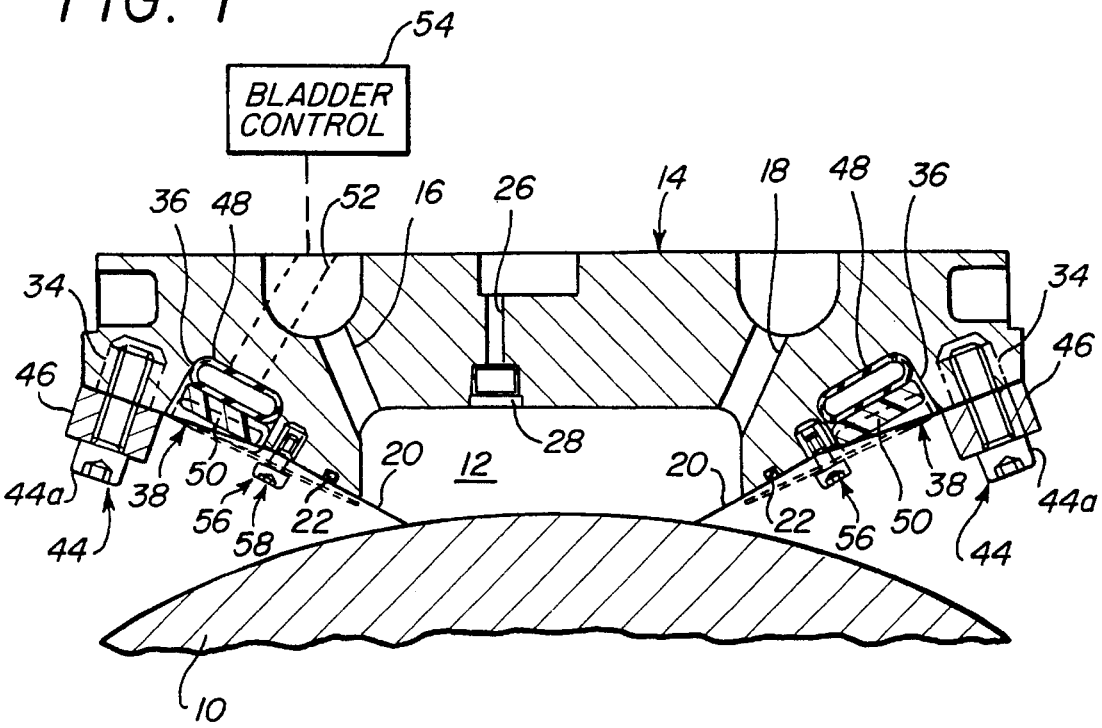
FIG. 1 is cross-sectional view of a chamber body with a doctor blade clamping assembly according to a first embodiment of the present invention.
Figure 2:
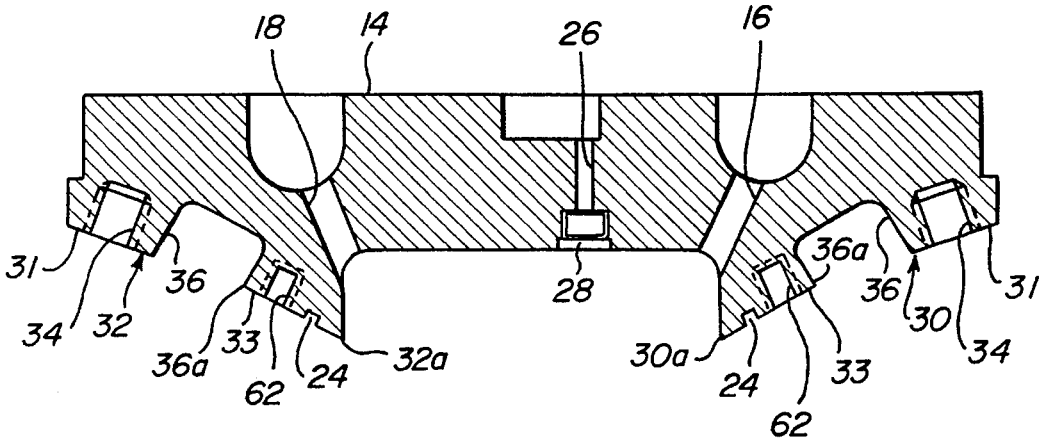
FIG. 2 is a cross-sectional view of the chamber body of FIG. 1 without the doctor blade clamping assembly and with the orientation reversed by 180° from that shown in FIG. 1.

Referring to the drawings in detail, and initially to FIGS. 1–4, in a flexographic printing press, an ink transfer or anilox roll 10 transfers ink to an adjacent plate roll (not shown) for printing. Ink is supplied to anilox roll 10 from an ink chamber 12 defined by a chamber body 14 which partially surrounds anilox roll 10. Specifically, ink is supplied to ink chamber 12 through an ink supply line 16 in chamber body 14, and ink is removed from ink chamber 12 through an ink return line 18 in chamber body 14.

With this arrangement, the outer surface of anilox roll 10 passes through ink chamber 12 and picks up ink for printing. The ink is metered by means of doctor blades 20 held to the inlet and outlet ends of chamber body 14, with the free ends of doctor blades 20 being in contact with the outer surface of anilox roll 10. O-ring seals 22 are provided in recesses 24 of chamber body 14, in contact with doctor blades 20, to prevent migration of ink.

In addition, chamber body 14 includes a cleaning solution supply line 26 having spraying means 28 for spraying a cleaning solution into ink chamber 12, in order to clean ink chamber 12 and anilox roll 10.

As shown, chamber body 14 includes inclined surfaces 30 and 32 at the inlet and outlet ends thereof that converge in directions toward each other, and which terminate at inner edges **30*a* and 32*a* thereof corresponding to the outer boundaries of ink chamber 12. Each inclined surface 30 and 32 is comprised of an outer inclined portion 31 and an inner inclined portion 33, with inner inclined portion 33 having a slightly steeper slope than outer inclined portion 31**.

The recesses 24 are provided in inner inclined portions 33, at positions spaced immediately outwardly of inner edges 30*a* and 32*a*. Further, a plurality of threaded bolt holes 34 are provided in outer inclined portions 31 of each inclined surface 30 and 32. In addition, large recessed areas 36 are also provided in outer inclined portions 31, at positions between the respective smaller recesses 24 and threaded bolt holes 34.

With this arrangement, a doctor blade 20 is positioned against inner inclined portion 33 of each inclined surface 30 and 32, such that the rear edges of doctor blades 20 extend outwardly or rearwardly almost to the junction of inner and outer inclined portions 31 and 33, and such that the front edges of doctor blades 20 are in contact with anilox roll 10. In this position, O-ring seals 22 prevent migration of ink between doctor blades 20 and the front and rear inclined surfaces 30 and 32.

Figure 3:
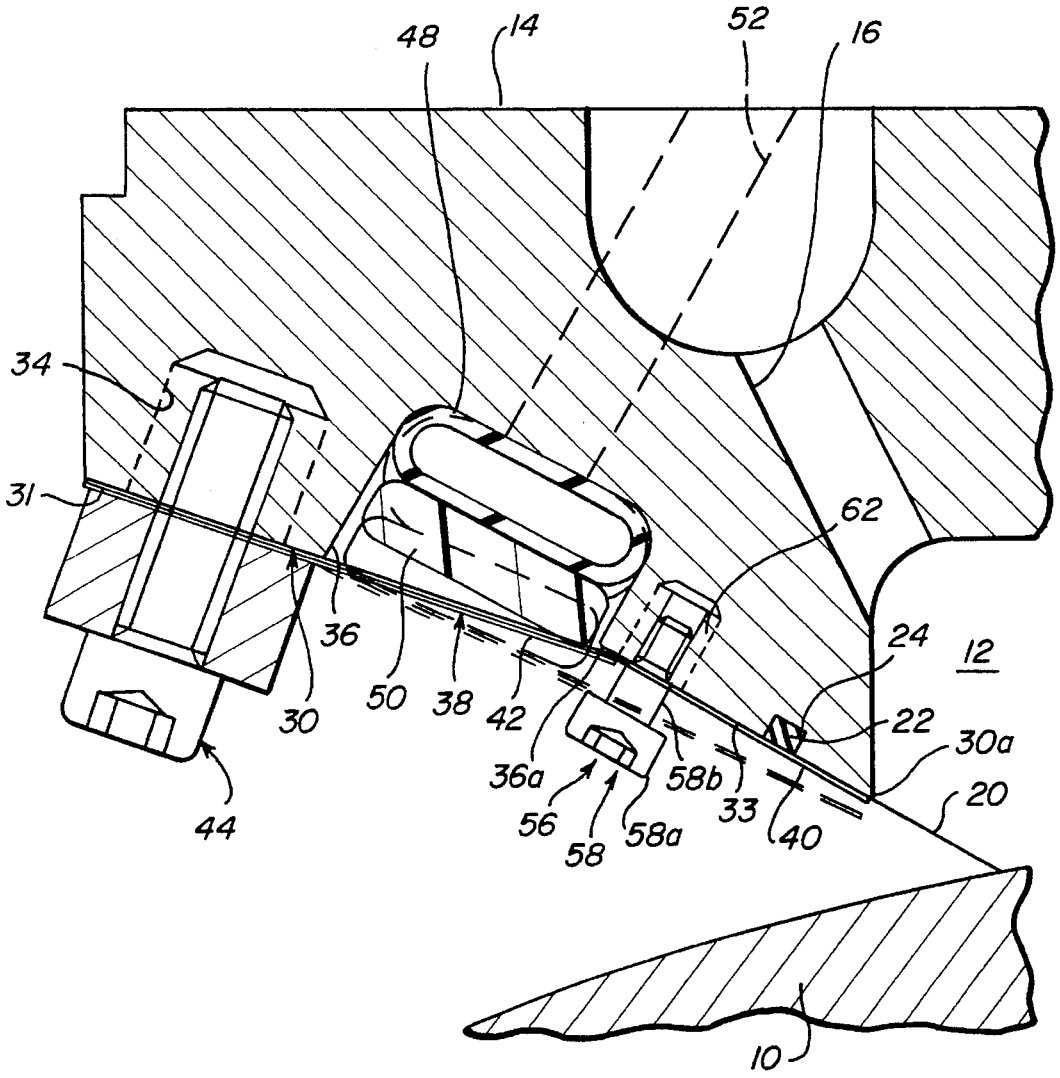
FIG. 3 is an enlarged cross-sectional view of a portion of the chamber body with the doctor blade clamping assembly of FIG. 1.
Figure 4:
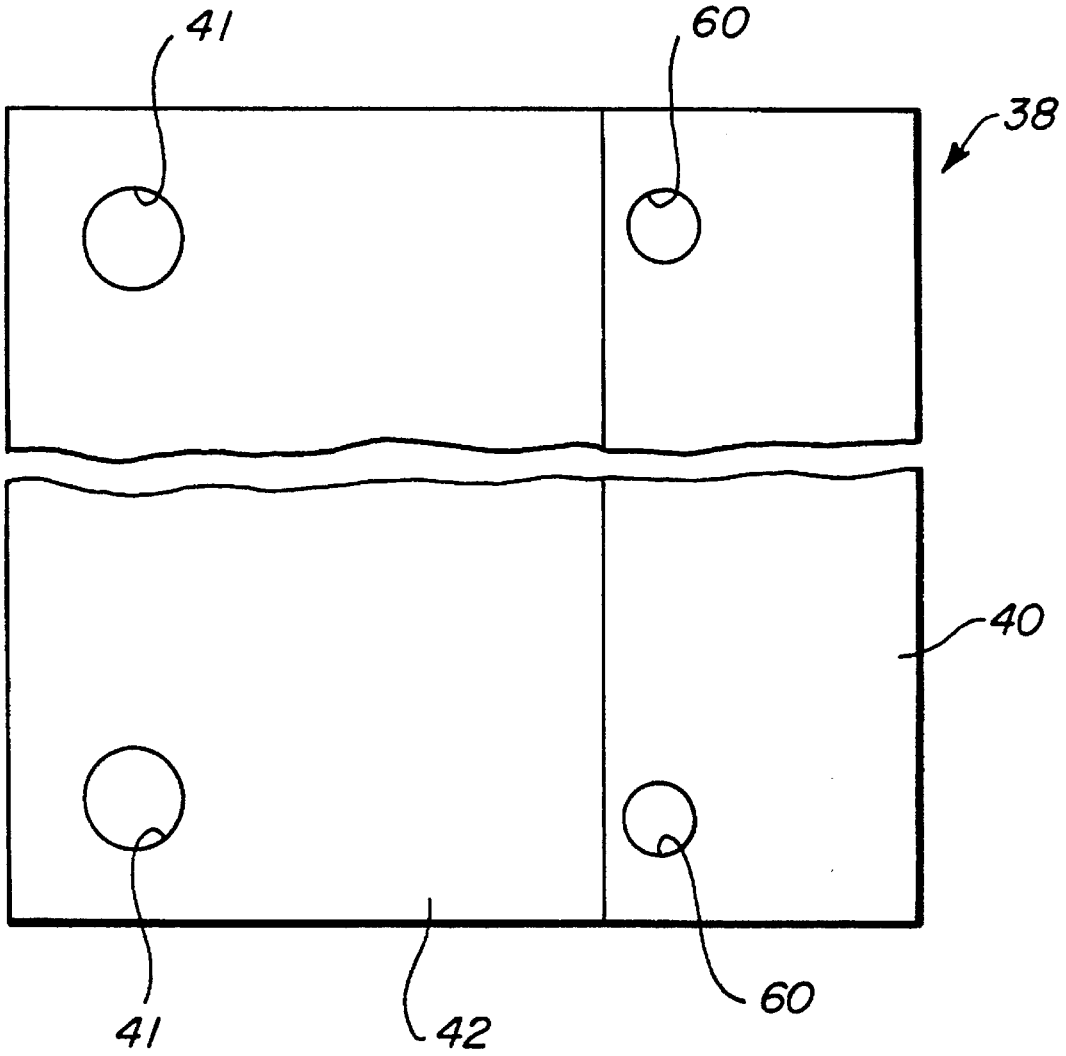
FIG. 4 is a top plan view of the leaf spring.

In accordance with the present invention, in order to clamp each doctor blade 20 in this position, a leaf spring 38 is secured to each inclined surface 30 and 32 so as to partially overlie doctor blades 20, and thereby apply a biasing force to doctor blades 20 to retain the same in position. As best shown in FIG. 3, each leaf spring 38 is preferably comprised of a primary leaf 40 which overlies the respective doctor blade 20 and a secondary leaf 42 which overlies first leaf 40, but which does not overlie the respective doctor blade 20. Each primary leaf 40 has a length substantially equal to the length of each inclined surface 30 and 32, while each secondary leaf 42 has a length that extends inwardly to a position just past the inner edge 36*a* of the respective large recessed area 36. Alternatively, secondary leaf 42 may be eliminated, or still further, more than two leaves may be provided for each leaf spring 38. Further, although a leaf spring 38 has been shown and described, any other biasing means can be used in place thereof, such as a coil spring, inflatable bladder or the like.

Bolts 44 extend through holes 41 at rear portions of leaves 40 and 42 of each leaf spring 38, and are threadedly received in threaded bolt holes 34. A spacer washer 46 is preferably positioned between the enlarged head 44*a* of each bolt 44 and the respective leaf spring 38 so that the turning forces of enlarged heads 44*a* are not transferred to leaf springs 38.

As a result of this arrangement, and as best shown in FIG. 3, leaf springs 38 apply a large pressure on doctor blades 20, for example, on the order of 80 psi, thereby fixing doctor blades 20 at their respective positions.

When a doctor blade 20 becomes caked with ink and/or wears out, it is necessary to remove the doctor blade 20 and replace it with a new doctor blade. However, because of the large forces applied by leaf springs 38, finger pressure is insufficient to overcome this large force.

Therefore, in accordance with the present invention, an inflatable bladder 48 is positioned in each large recessed area 36, along with a spacer 50. Spacer 50 is interposed between and in contact with inflatable bladder 48 and the primary leaf 40 of each leaf spring 38.

In the normal operating position, bladder is deflated, as shown by the solid lines in FIGS. 1 and 3, whereby primary leaf 40 is pressed against inclined surfaces 30 and 32 and presses down on doctor blade 20 to hold the same in position.

On the other hand, to release a doctor blade 20, the respective bladder 48 is inflated, and thereby pushes spacer 50 out of the large recessed area 36 so as to move leaf spring 38 to the position shown by dashed lines in FIGS. 1 and 3. As a result, doctor blade 20 is no longer held by leaf spring 38 so that it can be easily removed and changed. When the doctor blade 20 has been changed, bladder 48 is deflated, whereby leaf spring 38 pushes spacer 50 back into the large recessed area 36 and assumes the position shown by solid lines in FIGS. 1 and 3.

In order to control inflation and deflation of bladder 48, a conduit 52 extends from the rear face of chamber body 14 to the large recessed area 36, and is connected with bladder 48 thereat. A bladder control 54 is connected with conduit 52 to control inflation and deflation of bladder 48. Specifically, bladder control 54 supplies pressurized air or other gas to the bladder 48 to inflate the same, and provides a suction to remove the pressurized air or other gas from the bladder 48. As shown in FIG. 1, only one conduit 54 is shown for both bladders 48 on the entry and exit sides of chamber body 14. In this regard, the connection between the bladders 48 on both sides of chamber body 14 is not shown. However, separate conduits 52 may be provided for each bladder 48.

In order to limit the extent that a leaf spring 38 can be biased outwardly by a bladder 48 and spacer 50, a stop 56 is secured to chamber body 14. Specifically, stop 56 is formed by the enlarged heads 58*a* of bolts 58, with the shafts 58*b* of bolts 58 extending through respective holes 60 formed only in primary leaf 40 and being threadedly engaged within threaded bolt holes 62 formed in inner inclined portion 33 of inclined surfaces 30 and 32. As shown, each bolt head 58*a* is spaced from inner inclined portion 33 so that leaf spring 38 abuts thereagainst when biased by bladder 48 and spacer 50. In this manner, the extent that a leaf spring 38 can be biased away from an inclined surface 30 or 32 can be varied by adjusting bolts 58.

Thus, with the present invention, there is no need to loosen or tighten bolts in a small space. It is merely necessary to inflate the bladders 48, remove the defective doctor blades 20, insert new doctor blades 20, and then deflate the bladders 48.

It will be appreciated that spacer 50 can be eliminated so that bladder 48 directly contacts leaf spring 38.

Having described specific preferred embodiments of the invention with reference to the accompanying drawings, it will be appreciated that the present invention is not limited to those precise embodiments and that various changes and modifications can be effected therein by one of ordinary skill in the art without departing from the scope or spirit of the invention as defined by the appended claims.

What is claimed is:

1. In a printing press having a chamber body positioned adjacent a roll, a doctor blade clamping assembly comprising:

spring means for applying a biasing force to a doctor blade so as to clamp the doctor blade to the chamber body, said spring means including a leaf spring;

securing means for securing the spring means to the chamber body in at least partial overlying relation to the doctor blade such that the spring means applies said biasing force to the doctor blade to clamp the doctor blade to the chamber body and such that said spring means is positioned entirely on a side of said doctor blade which is opposite to the chamber body so as to sandwich the doctor blade therebetween; and biasing means for biasing the spring means to move the spring means in a direction away from the doctor blade to release the doctor blade from said biasing force.

2. A doctor blade clamping assembly according to claim 1, further including stop means for limiting movement of said spring means in a direction away from the doctor blade.

3. In a printing press having a chamber body positioned adjacent to a roll, a doctor blade clamping assembly comprising:

spring means for applying a biasing force to a doctor blade so as to clamp the doctor blade to the chamber body, said spring means including a leaf spring, said leaf spring including a plurality of leaves assembled together in overlying relation to each other, and at least some of said leaves being of different lengths;

securing means for securing the spring means to the chamber body in at least partial overlying relation to the doctor blade such that the spring means applies said biasing force to the doctor blade to clamp the doctor blade to the chamber body; and biasing means for biasing the spring means in a direction away from the doctor blade to release the doctor blade from said biasing force.

4. In a printing press having a chamber body positioned adjacent a roll, a doctor blade clamping assembly comprising:

spring means for applying a biasing force to a doctor blade so as to clamp the doctor blade to the chamber body, said spring means including a leaf spring;

securing means for securing the spring means to the chamber body in at least partial overlying relation to the doctor blade such that the spring means applies said biasing force to the doctor blade to clamp the doctor blade to the chamber body, said securing means including at least one bolt extending partially through said leaf spring and secured to said chamber body; and biasing means for biasing the spring means in a direction away from the doctor blade to release the doctor blade from said biasing force.

5. In a printing press having a chamber body including a recessed area and positioned adjacent a roll, a doctor blade clamping assembly comprising:

spring means for applying a biasing force to a doctor blade so as to clamp the doctor blade to the chamber body;

securing means for securing the spring means to the chamber body in at least partial overlying relation to the doctor blade such that the spring means applies said biasing force to the doctor blade to clamp the doctor blade to the chamber body; and biasing means for biasing the spring means in a direction away from the doctor blade to release the doctor blade from said biasing force, said biasing means including inflatable bladder means positioned in said recessed area for biasing said spring means in a direction away from the doctor blade to release the doctor blade from said biasing force of said spring means.

6. A doctor blade clamping assembly according to claim 5, wherein said biasing means includes:

a conduit extending through said chamber body and connected with said bladder means, and bladder control means, connected with said conduit, for controlling inflation and deflation of said bladder means through said conduit.

7. A doctor blade clamping assembly according to claim 5, wherein said biasing means further includes a spacer positioned in said recessed area between said bladder means and said spring means.

8. In a printing press having a chamber body positioned adjacent a roll, a doctor blade clamping assembly comprising:

spring means for applying a biasing force to a doctor blade so as to clamp the doctor blade to the chamber body;.

securing means for securing the spring means to the chamber body in at least partial overlying relation to the doctor blade such that the spring means applies said biasing force to the doctor blade to clamp the doctor blade to the chamber body;

biasing means for biasing the spring means in a direction away from the doctor blade to release the doctor blade from said biasing force; and stop means for limiting movement of said spring means in a direction away from the doctor blade, said stop means including a bolt extending partially through said spring means and secured to said chamber body.

9. In a printing press having a chamber body, a doctor blade clamping assembly comprising:

a leaf spring;

a securing assembly secured to the chamber body and engaging the spring to secure the spring to the chamber body in at least partial overlying relation to a doctor blade such that the spring applies a biasing force to the doctor blade to clamp the doctor blade to the chamber body and such that said spring is positioned entirely on a side of said doctor blade which is opposite to the chamber body so as to sandwich the doctor blade therebetween; and a biasing assembly positioned in a recessed area in the chamber body and which biases the spring to move the spring in a direction away from the doctor blade to release the doctor blade from said biasing force.

10. A doctor blade clamping assembly according to claim 9, further including a stop engaged with said chamber body and said spring for limiting movement of said spring in a direction away from the doctor blade.

11. In a printing press having a chamber body, a doctor blade clamping assembly comprising:

a spring including a leaf spring, said leaf spring including a plurality of leaves assembled together in overlying relation to each other, said leaves being of different lengths;

a securing assembly secured to the chamber body and engaging the spring to secure the spring to the chamber body in at least partial overlying relation to a doctor blade such that the spring applies a biasing force to the doctor blade to clamp the doctor blade to the chamber body; and a biasing assembly positioned in a recessed area in the chamber body and which biases the spring in a direction away from the doctor blade to release the doctor blade from said biasing force.

12. A doctor blade clamping assembly according to claim 11, wherein said securing assembly includes at least one bolt extending through said leaf spring and secured to said chamber body.

13. In a printing press having a chamber body, a doctor blade clamping assembly comprising:

a spring;

a securing assembly secured to the chamber body and engaging the spring to secure the spring to the chamber body in at least partial overlying relation to a doctor blade such that the spring applies a biasing force to the doctor blade to clamp the doctor blade to the chamber body; and a biasing assembly positioned in a recessed area in the chamber body and which biases the spring in a direction away from the doctor blade to release the doctor blade from said biasing force, said biasing assembly including an inflatable bladder positioned in said recessed area, said inflatable bladder at least indirectly engaging said spring when the bladder is inflated so as to bias said spring in a direction away from the doctor blade to release the doctor blade from said biasing force of said spring.

14. A doctor blade clamping assembly according to claim 13, wherein said biasing assembly includes:

a conduit connected with said bladder, and a bladder control connected with said conduit, the bladder control supplying a pressurized gas through said conduit to said bladder to inflate the bladder and removing the pressurized gas from said bladder through said conduit to deflate the bladder.

15. A doctor blade clamping assembly according to claim 13, wherein said biasing assembly further includes a spacer positioned in said recessed area between said bladder and said spring.

16. In a printing press having a chamber body, a doctor blade clamping assembly comprising:

a spring;

a securing assembly secured to the chamber body and engaging the spring to secure the spring to the chamber body in at least partial overlying relation to a doctor blade such that the spring applies a biasing force to the doctor blade to clamp the doctor blade to the chamber body;

a biasing assembly positioned in a recessed area in the chamber body and which biases the spring in a direction away from the doctor blade to release the doctor blade from said biasing force; and a stop engaged with said chamber body and said spring for limiting movement of said spring in a direction away from the doctor blade, said stop including a bolt extending partially through said spring and secured to said chamber body.

17. In a printing press having a chamber body, a doctor blade clamping assembly comprising:

a leaf spring;

at least one bolt extending through said leaf spring and secured to said chamber body, said at least one bolt engaging the leaf spring to secure the leaf spring to the chamber body in at least partial overlying relation to a doctor blade such that the leaf spring applies a biasing force to the doctor blade to clamp the doctor blade to the chamber body;

an inflatable bladder positioned in a recessed area in the chamber body and at least indirectly engaging said leaf spring when the bladder is inflated so as to bias said leaf spring in a direction away from the doctor blade to release the doctor blade from said biasing force of said leaf spring; and a stop engaged with said chamber body and said leaf spring for limiting movement of said leaf spring in a direction away from the doctor blade.

18. A doctor blade clamping assembly according to claim 17, wherein said leaf spring includes a plurality of leaves assembled together in overlying relation to each other, said leaves being of different lengths.

19. A doctor blade clamping assembly according to claim 17, further including:

a conduit connected with said bladder, and a bladder control connected with said conduit, the bladder control supplying a pressurized gas through said conduit to said bladder to inflate the bladder and removing the pressurized gas from said bladder through said conduit to deflate the bladder.

20. A doctor blade clamping assembly according to claim 17, further including a spacer positioned in said recessed area between said bladder and said leaf spring.

21. A doctor blade clamping assembly according to claim 17, wherein said stop includes a bolt extending partially through said leaf spring and secured to said chamber body.

* * * * *